United States Patent [19]

Barnes et al.

[11] 4,036,403

[45] July 19, 1977

[54] FUEL DISPENSING ARRANGEMENT

[76] Inventors: Gerald O. Barnes, 6616 Plank Road, Charlotte, N.C. 28216; Charles E. Horne, 1241 Cheshire Ave., Charlotte, N.C. 28208

[21] Appl. No.: 624,533

[22] Filed: Oct. 22, 1975

[51] Int. Cl.[2] ..... B67D 5/22

[52] U.S. Cl. ..... 222/23; 222/25; 222/39

[58] Field of Search ..... 222/23, 25–28, 222/32–35, 39; 194/13; 235/92 FL, 151.34; 340/239 R, 151; 116/112

[56] References Cited

U.S. PATENT DOCUMENTS

| | | | |
|---|---|---|---|
| 2,980,293 | 4/1961 | Leitte | 222/39 |
| 3,244,323 | 4/1966 | Stankiewicz | 222/27 X |
| 3,448,895 | 6/1969 | Mesh | 222/34 X |
| 3,498,501 | 3/1970 | Robbins et al. | 222/26 |
| 3,593,883 | 7/1971 | Robbins | 222/35 X |

*Primary Examiner*—Robert B. Reeves

*Assistant Examiner*—Joseph J. Rolla

*Attorney, Agent, or Firm*—Bell, Seltzer, Park & Gibson

[57] ABSTRACT

A fuel dispensing arrangement having a dispenser with an electrically driven pump for delivering fuel, a control located remotely from the dispenser and operable by a supervisor for selectively enabling fuel delivery, relays switchable among a plurality of states and connected with the control for responding thereto by switching to a first state enabling energization of the pump in preparation for fuel delivery and connected with the dispenser for responding thereto by switching to a second state energizing the pump on initiation of fuel delivery from the dispenser and to a third state disabling energization of the pump on termination of fuel delivery. In accordance with this invention, a warning device is located at the control and is operatively connected with the relays for signaling to the supervisor that the relays are in the third state so that the attention of the supervisor is directed to the termination of fuel delivery from the dispenser.

8 Claims, 2 Drawing Figures

FUEL DISPENSING ARRANGEMENT

Figure 1:
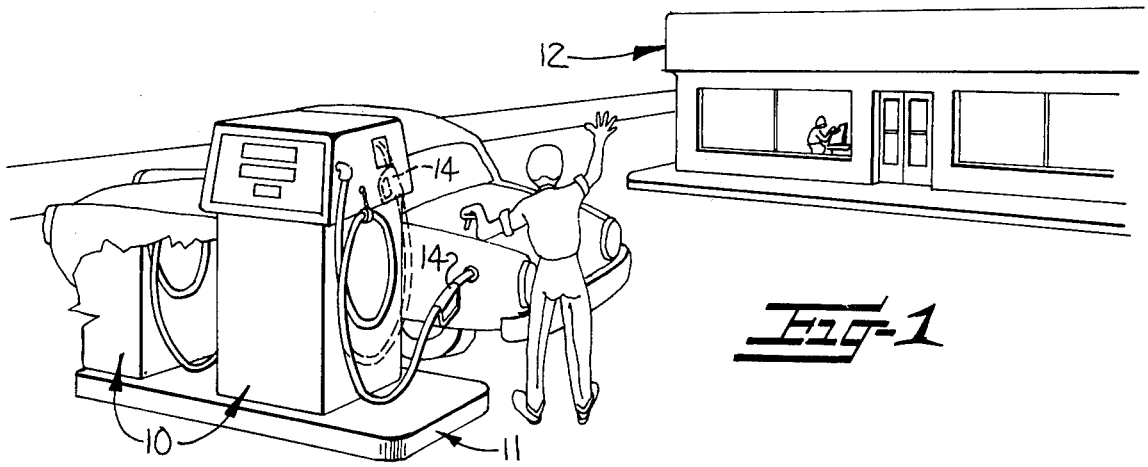

Sales of fuel for motor vehicles, and particularly of gasoline for passenger automobiles and the like, has increasingly come to use "self serve" dispensing locations. At such locations, a vehicle driver or occupant is expected to manipulate the controls of a dispenser means such as a conventional island mounted gas dispenser to deliver fuel into his vehicle. The difficulties anticipated in such operation of a fuel selling business have been anticipated by certain previously proposed arrangements, which typically provide a control located remotely from the dispenser and operable by a supervisor. Such remote controls frequently include remote indicating means which register the quantities or valve of fuel delivered from a dispenser.

As will be appreciated from a study of such prior arrangements, remotely monitoring quantities or value of fuel delivered requires relatively complex electrical and electronic arrangements. Installation of such arrangements has been accommodated in the construction of new fuel dispensing locations, but is significantly more difficult in instances where conversion of an existing location is under consideration.

For the last mentioned reason, it has heretofore been proposed to provide a fuel dispensing arrangement in which only existing wiring need be employed in converting an existing attended fuel dispensing location into a self serve dispensing location. Such conversions, which have a noticeable history of success, involve placing control over the functions of a fuel dispenser in the hands of a supervisor located remotely from the dispenser, as within an attendant's booth or store building. In such arrangements, relays electrically connected with prior existing wiring function to permit the remote supervisor to enable a vehicle operator or occupant to dispense fuel and to disable the dispenser from further delivery of fuel after fuel delivery has been terminated.

While such arrangements have achieved acceptance, difficulties remain in that the attention of the remote supervisor may be distracted from the fuel dispenser and a customer may succeed in departing without paying for fuel delivered. Such occurrences are a particular risk where fuel sales are ancillary to other businesses such as the operation of a convenience store selling groceries and the like.

Yet another risk is the possibility of fire occurring at the self serve dispenser. As will be appreciated, any occurrence of fire at a self serve dispenser operated by a consumer exposes the consumer and the facility to greater risk than would be the case where the dispenser is operated by a trained attendant.

It is an object of the present invention to provide a fuel dispensing arrangement which overcomes the difficulties and deficiencies heretofore encountered in self serve locations. In realizing this object of the present invention, an arrangement is proposed which readily accommodates conversion of an existing attended dispensing location into a self serve dispensing location, while assuring that a remotely located supervisor is advised of events occurring at the self serve dispenser and may properly oversee fuel sale business transactions.

Yet a further object of this invention is the provision of a fuel dispensing arrangement wherein a remotely located supervisor may readily observe the operating condition of one or more self serve dispensers and may, where necessary, interrupt any delivery of fuel in the event of an emergency. In realizing this object of the present invention, indicators are provided at a control located remotely from a fuel dispenser for permitting a supervisor to readily determine the operating condition of one or more dispenser means. Further, an emergency stop is provided to permit the remote supervisor to interrupt all delivery of fuel from a self serve dispenser if required in the event of an emergency such as a fire.

Figure 2:
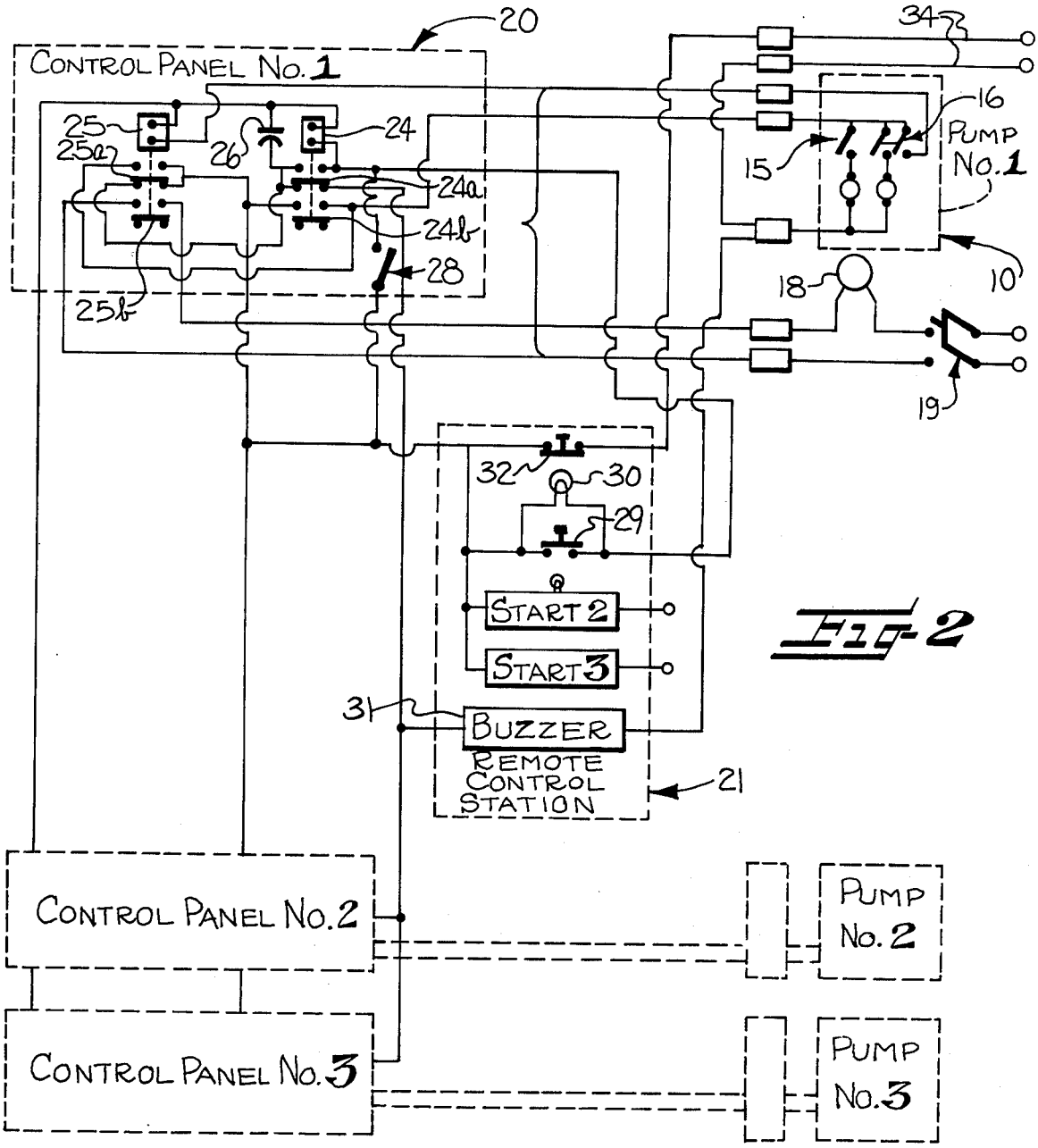

Some of the objects of the invention having been stated, other objects will appear as the description proceeds, when taken in connection with the accompanying drawings, in which FIG. 1 is a perspective view of a fuel dispensing location incorporating the present invention; and FIG. 2 is a schematic electrical diagram of a fuel dispensing arrangement in accordance with this invention.

The present invention will be described more particularly hereinafter with reference to the accompanying drawing, in which a presently preferred form of the fuel dispensing arrangement of this invention is disclosed. However, it is to be understood at the outset that it is contemplated that persons skilled in the applicable control arts may vary the details of a fuel dispensing arrangement from those illustrated while accomplishing the desirable objectives of the present invention. Accordingly, the accompanying drawing and the following description are to be taken as a broad and enabling disclosure of this invention, rather than a restriction on the present invention.

As known to consumers who have used such facilities, a self serve fuel dispensing location may typically include a plurality of dispensing means (one of which is indicated generally at 10 in FIG. 1) which may take the form of dispensing pump devices mounted on an island 11 adjacent a driveway or other paved area. Fuel such as gasoline is dispensed from such a dispenser means 10 into vehicles such as the automotive vehicle shown in FIG. 1. In accordance with the present invention, delivery of fuel from the dispenser means 10 into an automotive vehicle is accomplished by the vehicle operator or other occupant, under the general supervision of a remote supervisor who may remain within an adjacent or nearby building such as a convenience store 12. The dispensing of fuel typically involves a vehicle operator or occupant removing a nozzle 14 from the fuel dispenser means 10, operating a lever on the fuel dispenser means 10 to energize a pump for delivering fuel (as described more fully hereinafter), opening a valve on the nozzle 14 while positioning the nozzle into a fuel tank to deliver fuel thereinto and, on completion of fuel delivery, restoring the nozzle 14 to its position on the fuel dispenser 10 and thereby deenergizing the pump.

Referring now more particularly to FIG. 2, the fuel dispenser means 10 is there shown as including a single pole single throw reset switch 15 and a double pole single throw nozzle switch 16, successively operated by an electrical motor resetting the registers of the dispenser means 10 and by a person operating the dispenser means 10 as described hereinabove. As is known to persons familiar with the art of fuel dispensing to which this invention relates, a submerged turbine pump 18 is normally supplied with an appropriate line voltage through a master switch generally indicated at 19 and is energized as described more fully hereinafter to deliver fuel through the nozzle 14 as described hereinabove.

Electrically connected with the switches 15, 16 and turbine pump 18 is a control panel generally indicated at 20 and a supervisor's remote control station generally indicated at 21. Panel 20 may be located at any appropriate position within the building 12, such as a back room or other area closed to customers, while the remote control station 21 desirably is positioned adjacent a window or the like so that the supervisor or store operator may simultaneously view both the remote control station 21 and the dispenser means 10.

The control panel 20 includes a pair of relay means each having a control winding and corresponding contact sets. A first relay includes a control winding 24, and first and second contact sets 24*a*, 24*b*. A second relay includes a control winding 25 and first and second contact sets 25*a*, 25*b*. The control panel 20 additionally includes a time delay capacitor 26 electrically connected with the control winding 24 of the first relay and functioning as described more fully hereinafter.

The control panel 20 may additionally include a convertor switch generally indicated at 28, which may be selectively closed to permit normal, attended operation of the dispenser means 10 as an alternative to self serve operation as more fully described herein.

The remote control station 21 includes, for each dispenser means to be operated in a self serve fashion, an enable switch such as the switch 29 operatively associated with the dispenser means 10 as described more fully hereinafter. For each enable switch such as the switch 29, a warning light means 30 is provided, preferably in the form of a neon bulb connected across the terminals of the corresponding enable switch 29. The remote control station 21 additionally includes an audible signal means such as a buzzer 31 for generating sound in response to switching of the first and second relay means as described more fully hereinafter, and an emergency stop means in the form of a normally closed switch 32.

As will be noted from FIG. 2, the present invention contemplates that more than a single dispenser means 10 may be operated in a self serve manner at any given fuel dispensing location. More particularly, provision is made for a second and third pump, with corresponding control panels. As indicated, appropriate enable switches are provided at a single remote control station 21 for accommodating whatever number of fuel dispensing means are deemed necessary or appropriate. In each instance, the operation of a particular fuel dispenser means is essentially similar and, for that reason, detailed drawings and description have been provided for only one fuel dispensing means, with the expectation that persons skilled in the applicable arts will be able to duplicate the structure and operation described as necessary to enlarge the number of fuel dispensing means served by the arrangement of this invention.

In operation in a self serve mode, the switch 19 is normally closed to make line voltage available to the submerged turbine pump 18. At the same time, line voltage is made available to the control portions of the fuel dispensing means of this arrangement through line conductors 34, in a generally known manner. On a vehicle operator or occupant desiring to purchase fuel, the vehicle to receive fuel is positioned adjacent the dispenser means 10 and the remote supervisor signaled that a fuel purchase was desired. Prior to or on such signaling, the remote supervisor momentarily closes the normally open enabling switch 29, energizing the control winding 24 of the first relay and extinguishing the electrical lamp means 30 associated with the enabling switch 29. Upon energization of the winding 24 of the first relay, the associated contact sets 24*a*, 24*b* are moved to a winding energized position (upwardly in FIG. 2) respectively completing a holding circuit to maintain energization of the first winding 24 and completing a circuit by which voltage may be applied to the electrical switches 15, 16 associated with the fuel dispenser means 10. Such actuation of the first relay is here referred to as switching of the relays to a first state, which first state enables energization of the pump means 18 in preparation for fuel delivery from the dispenser means 10.

Upon resetting of the dispenser means registers and removal of the nozzle 14 from the fuel dispenser means 10 by a person desiring to purchase fuel, electrical switches 15, 16 at the dispenser means 10 are closed with resetting of the registers of the dispenser means 10 and delivery of fuel from the pump 18 to the nozzle 14, as generally known to persons familiar with the arts relating to such fuel dispensing means. At the same time, closure of the switches 15, 16 energizes the winding 25 of the second relay means, drawing the associated contact sets 25*a*, 25*b* to a winding energized position (upwardly in FIG. 2). With the change in conductive state of the contact sets 25*a*, 25*b* of the second relay, the winding 24 of the first relay is deenergized and, after an interval timed by the discharge of the capacitor 26 through the winding 24, then returns the associated contact sets 24*a*, 24*b* to the position shown in FIG. 2. This condition of the relay means is referred to herein as the second state.

With the winding 25 of the second relay energized and the winding 24 of the first relay deenergized, a voltage differential appears across the corresponding enable switch 29 at the remote control station 21, thereby illuminating the neon lamp 30, and fuel is delivered through the nozzle 14 into a vehicle or the like. In the event of an emergency at the island 11 during such fuel delivery, such as a fire, the remote supervisor may interrupt all delivery of fuel from dispensing means at the island by opening normally closed emergency stop switch 32, which immediately deenergizes the winding 25 of the second relay and interrupts energization of any turbine pump 18 then being operated.

At the conclusion of normal fuel delivery, the consumer returns the nozzle 14 to its restored position, opening the switches 15, 16 in the fuel dispensing means 10. With the opening of the switches 15, 16, the winding 25 of the second relay is deenergized, permitting the associated contact sets 25*a*, 25*b* to return to the position illustrated in FIG. 2 which is here referred to as the third state. With such a change in the position of the contact sets, voltage is applied to the audible warning device 31, which may be in the form of a buzzer. Thus, the remote supervisor of the fuel dispensing means 10 is alerted that delivery of fuel from the dispensing means 10 has been completed. Being so alerted, the supervisor 10 may assure that the automobile operator or other occupant properly pays for the fuel received and may, if desired, extinquish the lamp 30 and terminate energization of the buzzer 31 by momentarily closing the enable switch 29.

In the drawings and specification, there has been set forth a preferred embodiment of the invention, and although specific terms are employed, they are used in a generic and descriptive sense only and not for purposes of limitation.

That which is claimed is:

1. In a fuel dispensing arrangement having dispenser means with electrically driven pump means for delivering fuel, control means located remotely from said dispenser means and operable by a supervisor for selectively enabling fuel delivery from said dispenser means; and relay means having contacts switchable among a plurality of conditions, said relay means being connected with said control means for responding thereto by switching to a first condition in which contacts are connected to enable energization of said pump means in preparation for fuel delivery from said dispenser means and connected with said dispenser means for responding thereto by switching to a second condition in which contacts are connected for energizing said pump means for delivering fuel from said dispenser means and to a third condition in which contacts are connected for de-energizing said pump means on termination of fuel delivery from said dispenser means and for precluding energization of said pump means until said relay means are returned to said first condition by operation of said control means; the improvement comprising warning means located at said control means and operatively connected with said relay means for signaling to a supervisor that said relay means is in said third condition whereby the attention of the supervisor is directed to the termination of fuel delivery from said dispenser means.

2. An arrangement according to claim 1 wherein said warning means is operatively connected with said relay means for interrupting signaling upon switching of said relay means to said first state.

3. An arrangement according to claim 1 wherein said warning means comprises audible signal means for generating sound in response to switching of said relay means to said third state.

4. An arrangement according to claim 1 wherein said warning means comprises electrical lamp means for visually indicating the switching of said relay means from said third state to said first state.

5. An arrangement according to claim 1 further comprising emergency stop means located at said control means and operatively connected to said relay means for selectively switching said relay means to said third state whereby a supervisor may selectively preclude fuel delivery from said dispenser in the event of fire and the like.

6. In a fuel dispensing arrangement having dispenser means with electrically driven pump means for delivering fuel, control means located remotely from said dispenser means and operable by a supervisor for selectively enabling fuel delivery from said dispenser means; and relay means having contacts switchable among a plurality of conditions, said relay means being connected with said control means for responding thereto by switching to a first condition in which contacts are connected to enable energization of said pump means in preparation for fuel delivery from said dispenser means and connected with said dispenser means for responding thereto by switching to a second condition in which contacts are connected for energizing said pump means for delivering fuel from said dispenser means and to a third condition in which contacts are connected for de-energizing said pump means on termination of fuel delivery from said dispenser means and for precluding energization of said pump means until said relay means are returned to said first condition by operation of said control means; the improvement comprising audible warning means located at said control means and operatively connected with said relay means for generating sound in response to switching of said relay means to said third condition and for interrupting generation of sound in response to switching of said relay means to said first condition whereby the attention of the supervisor is directed to the termination of fuel delivery from said dispenser means.

7. In a fuel dispensing arrangement having dispenser means with electrically driven pump means for delivering fuel, control means located remotely from said dispenser means and operable by a supervisor for selectively enabling fuel delivery from said dispenser means; and relay means having contacts switchable among a plurality of conditions, said relay means being connected with said control means for responding thereto by switching to a first condition in which contacts are connected to enable energization of said pump means in preparation for fuel delivery from said dispenser means and connected with said dispenser means for responding thereto by switching to a second condition in which contacts are connected for energizing said pump means for delivering fuel from said dispenser means and to a third condition in which contacts are connected for de-energizing said pump means on termination of fuel delivery from said dispenser means and for precluding energization of said pump means until said relay means are returned to said first condition by operation of said control means; the improvement comprising electrical lamp warning means located at said control means and operatively connected with said relay means for visually signaling to a supervisor that said relay means is in one of said second and third conditions and for interrupting such signaling upon switching of said relay means to said first condition.

8. In a fuel dispensing arrangement having a plurality of dispenser means each with corresponding electrically driven pump means for delivering fuel; control means located remotely from said dispenser means and operable by a supervisor for selectively enabling fuel delivery from said dispenser means; and a plurality of relay means having contacts corresponding to said dispenser means and each being switchable among a plurality of conditions, each said relay means being connected with said control means for responding thereto by switching to a first condition in which contacts are connected to enable energization of a corresponding pump means in preparation for fuel delivery from a corresponding dispenser means and connected with said corresponding dispenser means for responding thereto by switching to a second condition in which contacts are connected for energizing said corresponding pump means for delivering fuel from said corresponding dispenser means and to a third condition in which contacts are connected for de-energizing said corresponding pump means on termination of fuel delivery from said corresponding dispenser means and for precluding energization of said pump means until said relay means are returned to said first condition by operation of said control means; the improvement comprising audible warning means operatively connected with said plurality of relay means for signaling to a supervisor that at least one of said relay means is in said third condition, and a plurality of visual warning means each operatively connected with a corresponding one of said relay means for signaling to a supervisor that said corresponding one relay means is in one of said second and third conditions.

* * * * *